US010077533B2

(12) United States Patent
Meuwissen et al.

(10) Patent No.: US 10,077,533 B2
(45) Date of Patent: Sep. 18, 2018

(54) STRUCTURAL JOINT

(71) Applicant: Hengelhoef Concrete Joints NV, Genk (BE)

(72) Inventors: Dirk Meuwissen, Genk (BE); Albert Charles Klingeleers, Dilsen-Stokkem (BE); René Alice P. Winters, Maaselk (BE)

(73) Assignee: Hengelhoef Concrete Joints NV, Genk (BE)

( * ) Notice: Subject to any disclaimer, the term of this patent is extended or adjusted under 35 U.S.C. 154(b) by 197 days.

(21) Appl. No.: 14/380,803

(22) PCT Filed: Feb. 27, 2013

(86) PCT No.: PCT/EP2013/053849
§ 371 (c)(1),
(2) Date: Aug. 25, 2014

(87) PCT Pub. No.: WO2013/127812
PCT Pub. Date: Sep. 6, 2013

(65) Prior Publication Data

US 2015/0023725 A1 Jan. 22, 2015

(30) Foreign Application Priority Data

| | | |
|---|---|---|
| Feb. 27, 2012 | (GB) | 1203314.8 |
| Aug. 28, 2012 | (GB) | 1215277.3 |
| Nov. 8, 2012 | (GB) | 1220095.2 |

(51) Int. Cl.
*E01C 11/02* (2006.01)
*E01C 11/08* (2006.01)
*E01C 11/14* (2006.01)

(52) U.S. Cl.
CPC ..... *E01C 11/08* (2013.01); *E01C 11/14* (2013.01); *Y10T 403/21* (2015.01)

(58) Field of Classification Search
CPC ..... E01C 11/08; E01C 11/14; E01C 11/04; E04D 3/38; E04D 19/06; E04D 1/68; Y10T 403/21
See application file for complete search history.

(56) References Cited

U.S. PATENT DOCUMENTS 1,495,305 A * 5/1924 Heltzel ..... B02C 2/005 249/6
1,959,610 A * 5/1934 Bowman ..... E04D 3/38 52/521

(Continued)

FOREIGN PATENT DOCUMENTS

AT 113488 B 6/1929
BE 1015453 4/2003

(Continued)

OTHER PUBLICATIONS

International Search Report and Written Opinion dated Sep. 24, 2013 pertaining to PCT/EP2013/053849.

(Continued)

*Primary Examiner* — James M Ference
*Assistant Examiner* — Kyle Walraed-Sullivan
(74) *Attorney, Agent, or Firm* — Dinsmore & Shohl LLP

(57) ABSTRACT

The present invention relates to a expansion joint to bridge an expansion gap between two parts of concrete slabs used in floor construction, especially in the manufacture of concrete floors such as for example in industrial floors. Such expansion joints are evidently required to take up the inevitable shrinkage process of the concrete and to assure that the floor elements can expand or contract such as for example occur by temperature fluctuations and resulting in a horizontal displacement of the floor panels vis-à-vis one another.

19 Claims, 8 Drawing Sheets

(56) References Cited

Figure 1:
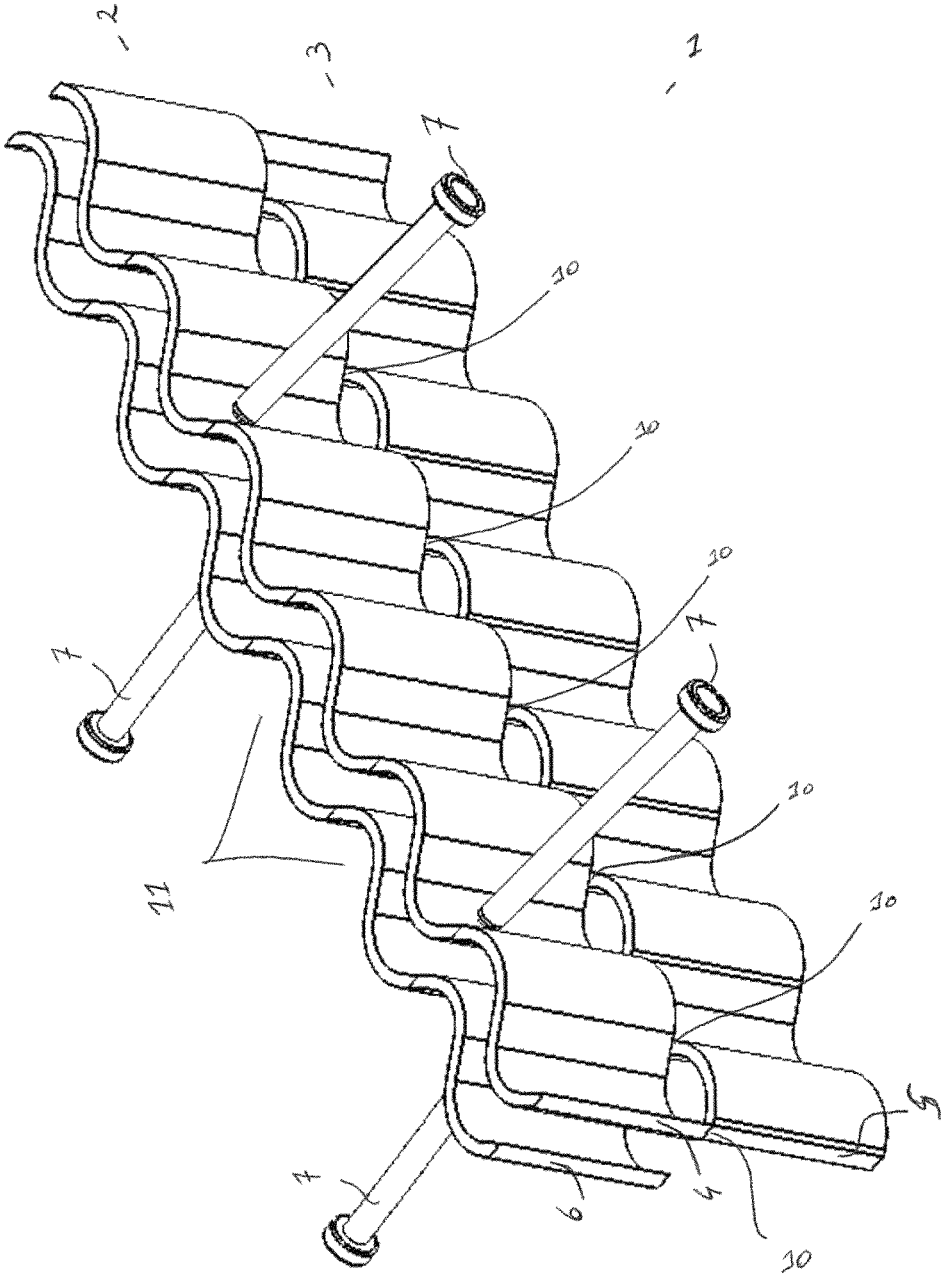

U.S. PATENT DOCUMENTS 2,039,144 A * 4/1936 Burgess ..... E01C 11/14 404/61
2,074,497 A * 3/1937 Voigt ..... E04D 3/365 52/394
2,078,693 A 4/1937 Simrall
2,149,291 A * 3/1939 Hofwolt ..... E01C 11/14 404/60
2,179,911 A * 11/1939 Wilmoth ..... E01C 11/14 404/61
2,205,810 A * 6/1940 Carter ..... E01C 11/14 404/49
2,278,023 A * 3/1942 Robertson ..... E01C 11/14 404/51
2,300,995 A 11/1942 Tufts
2,365,550 A * 12/1944 Heltzel ..... E01C 11/12 404/59
2,521,643 A * 9/1950 Mathers ..... E01C 11/14 404/61
2,822,588 A * 2/1958 West ..... E04D 3/38 27/19
3,344,720 A * 10/1967 Hallock ..... E01D 19/06 14/73.1
3,390,501 A * 7/1968 Driggers ..... E04B 1/6804 404/47
3,394,515 A * 7/1968 Widdowson ..... E04D 3/38 52/394
3,394,639 A * 7/1968 Viehmann ..... E01C 11/126 404/47
3,765,140 A * 10/1973 Harry ..... E04D 3/38 52/394
3,790,294 A * 2/1974 Trieste ..... E01D 19/06 404/68
3,998,016 A * 12/1976 Ting ..... E04H 9/14 52/1
4,332,504 A 6/1982 Arai
4,522,531 A * 6/1985 Thomsen ..... E01C 11/04 404/2
4,557,082 A * 12/1985 Dunsworth ..... E04B 1/6815 160/159
4,598,517 A * 7/1986 Alvarsson ..... B28B 7/0035 52/250
4,833,851 A * 5/1989 Ohmatsu ..... E04B 1/6804 404/52
4,848,044 A * 7/1989 LaRoche ..... E04B 1/6804 404/68
4,888,930 A * 12/1989 Kelly ..... E04D 3/3601 52/309.8
4,936,704 A * 6/1990 Killmeyer ..... E01C 11/04 404/68
5,028,168 A * 7/1991 Conversy ..... E01D 19/06 404/47
5,311,716 A * 5/1994 Houssin ..... E04D 13/1643 52/410
5,365,713 A * 11/1994 Nicholas ..... E04B 1/681 52/396.03
5,366,319 A * 11/1994 Hu ..... E01C 11/14 404/52
5,479,753 A * 1/1996 Williams ..... E04D 3/38 52/411
5,674,028 A 10/1997 Norin
6,044,602 A * 4/2000 Canavan ..... E04D 1/045 52/200
6,502,359 B1 1/2003 Rambo
8,677,712 B1 * 3/2014 Edmonds, Jr. ..... E01C 11/14 165/53
D710,038 S * 7/2014 Keen
2004/0016065 A1 * 1/2004 Steiger ..... E01D 19/062 14/73.1
2004/0107661 A1 * 6/2004 Michiels ..... E01C 11/14 52/396.05
2008/0222984 A1 9/2008 Michiels
2009/0007512 A1 * 1/2009 Kerrels ..... E01C 11/08 52/396.02
2010/0281808 A1 * 11/2010 Laiho ..... E01C 11/14 52/402
2010/0325996 A1 * 12/2010 Laiho ..... E01C 11/14 52/396.05
2014/0366472 A1 * 12/2014 Keen ..... E01C 11/08 52/396.05

FOREIGN PATENT DOCUMENTS

| | | | |
|---|---|---|---|
| BE | 1016147 | A3 | 4/2006 |
| DE | 3533077 | A1 | 3/1987 |
| DE | 102007020816 | B3 | 10/2008 |
| EP | 0410079 | A1 | 1/1991 |
| EP | 0609783 | A1 | 8/1994 |
| EP | 1584746 | A2 | 10/2005 |
| JP | H02296903 | A | 12/1990 |
| JP | 2011001776 | A | 1/2011 |
| JP | 2011080282 | A | 4/2011 |
| NL | D296860 | A | 5/1965 |
| WO | 03069067 | A1 | 8/2003 |
| WO | 2007144008 | A1 | 12/2007 |
| WO | 2010119157 | A1 | 10/2010 |

OTHER PUBLICATIONS

GB Search Report under Section 17 dated Jun. 22, 2012 pertaining to GB Application Serial No. 1203314.8.

* cited by examiner 72
43
5
16
16
16

STRUCTURAL JOINT

The present invention relates to a expansion joint to bridge an expansion gap between two parts of concrete slabs used in floor construction, especially in the manufacture of concrete floors such as for example in industrial floors. Such expansion joints are evidently required to take up the inevitable shrinkage process of the concrete and to assure that the floor elements can expand or contract such as for example occur by temperature fluctuations and resulting in a horizontal displacement of the floor panels vis-à-vis one another.

In addition, and given the fact that such floors are often subjected to high loads, further load transfer elements are typically included in the aforementioned joint profiles to assure that the vertical load on one floor panel is transmitted to the adjacent floor panel in an optimal way and thereby preventing a vertical tilting of the floor panels with respect to each other. However, when driving over such an expansion joint with heavily loaded vehicles such as forklifts, which often have particularly hard Vulkollan wheels, the presence of such load transfer elements cannot prevent damage of the upper circumferential edges of the slabs or to the wheels, due to the undesirable shock of the vehicle when passing the groove-like gap between the floor elements. This is especially due to the fact that the joint profile making up the edges of the floor elements is made of steel and therefore much harder than the commonly soft outer circumference surface of the wheels.

In an effort to address the drawback of the groove-like gap in the existing joint profiles, alternatives have been presented wherein the edges of the floor members by means of coggings interlock with one another. See for example AT113488, JP2-296903, DE3533077 or WO2007144008. However, in as far each of said arrangements ensures that the wheels when leaving one edge are already supported on the boundary of the other; the mere presence of such cogging interlocks is insufficient to prevent damage at the upper circumferential edges of the floor elements. Vertical tilting of the floor members may still result in differences in height between the plates which gives rise to edges, further shocks and eventual damages to the floor. Consequently, also in these interlocking joint profiles load transfer elements will be required to assure that the vertical load on one floor panel is transmitted to the adjacent floor panel in an optimal way and thereby preventing a vertical tilting of the floor panels.

Such load transfer elements come in different shapes and embodiments, such as for example wedge-shaped dowels (DE 102007020816); horizontal grooves and protrusions cooperating with one another (BE1015453, BE1016147); plate dowels (U.S. Pat. No. 5,674,028, EP1584746, US2008222984) or bar dowels (EP0410079, U.S. Pat. No. 6,502,359, WO03069067, EP0609783). Irrespective of their embodiment, said load transfer elements needs to be incorporated in the floor deck adding not only to a minimum thickness for the floor, but also to additional material to be used and to complexity in construction.

In addition, metal interlocking end plates such as shown in AT113488 and JP-2-29603, still result in an abrupt change of expansion coefficient at the boundary of the floor slabs. As a consequence, these end plates tend to loosen over time with floor damage at the boundary between the concrete floor slabs at the metal end plates.

It is therefore an object of the invention to provide a structural joint where no further load transfer elements are required, but still addressing the problems outlined hereinbefore.

This object is achieved in that the expansion joint itself structurally realizes load transfer. Thereto, the expansion joint according to the present invention has an upper and lower portion characterized in that the lower portion comprises a vertically oriented corrugated plate.

In a particular embodiment the expansion joint according to the present invention has an upper and lower portion each comprising a vertically oriented corrugated plate, characterized in that the corrugated plates of the upper and lower portion are out of phase to one another.

Within the context of the present invention, and as evident from the accompanying figures, the vertical orientation of the corrugated plates, is vertical with respect the floor surface, i.e. the plates are standing upright, i.e. perpendicular, with respect to the floor surface. In other words, with their thin side facing the floor surface.

In creating the upper edges of the concrete slabs, the upper portion of the expansion joint according to the present invention may further comprises a second vertically oriented corrugated plate that fits within the undulations of the vertically oriented corrugated plate of the upper portion to protect the upper edge of the opposing slab. Analogously, in creating the lower edges of the concrete slabs, the lower portion of the expansion joint according to the present invention may further comprise a second vertically oriented corrugated plate that fits within the undulations of the vertically oriented corrugated plate of the lower portion to protect the lower edge of the opposing slab.

Thus in a further embodiment of the present invention, the expansion joint of the present invention is characterized in having an upper (2) and lower (3) portion, each comprising two vertically oriented corrugated plates with undulations that fit in one another, and characterized in that the corrugated plates of the upper and lower portion are out of phase to one another.

The edge of a slab of concrete poured against the expansion joint of the present invention will have an denticulated upper portion and a denticulated lower portion both denticulations being out of phase to one another and interlocking with the denticulated upper and lower portion edge of the adjacent slab. In this way the adjacent slabs are fixed vertically to one another, but through the presence of the expansion joint, horizontal displacement of the adjacent slabs is still possible. Load transfer is realized through the dents at the edges of the concrete slabs and over an expansion width determined by the amplitude of the corrugations in the corrugated plates used in the expansion joint.

Other advantages and characteristics of the invention will become clear from the following description reference being made to the annexed drawings.

Herein is: □□

FIG. 1 A perspective top view of an expansion joint according to the present invention.

Figure 2:
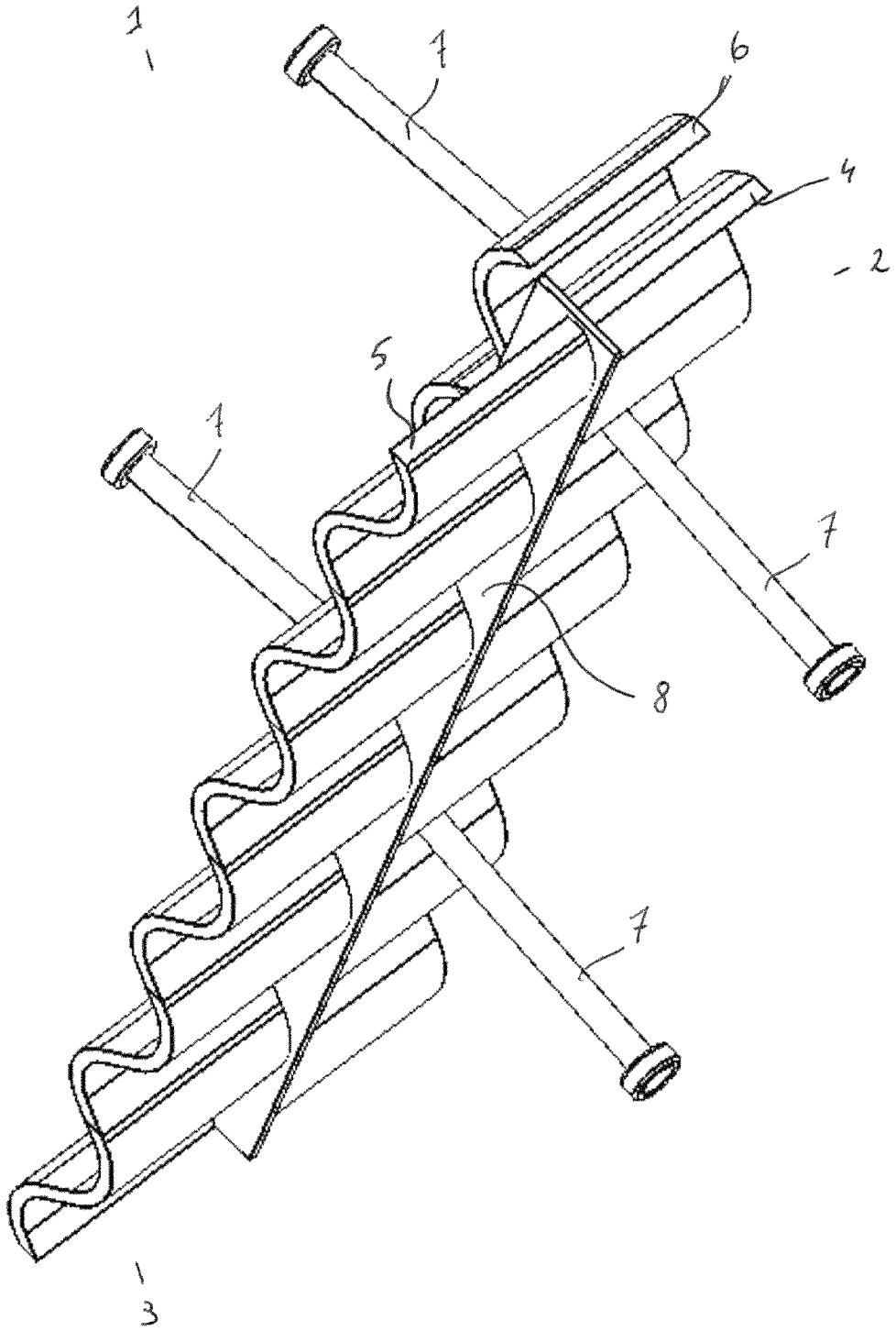

FIG. 2 A perspective bottom view of an expansion joint according to the present invention.

Figure 3:
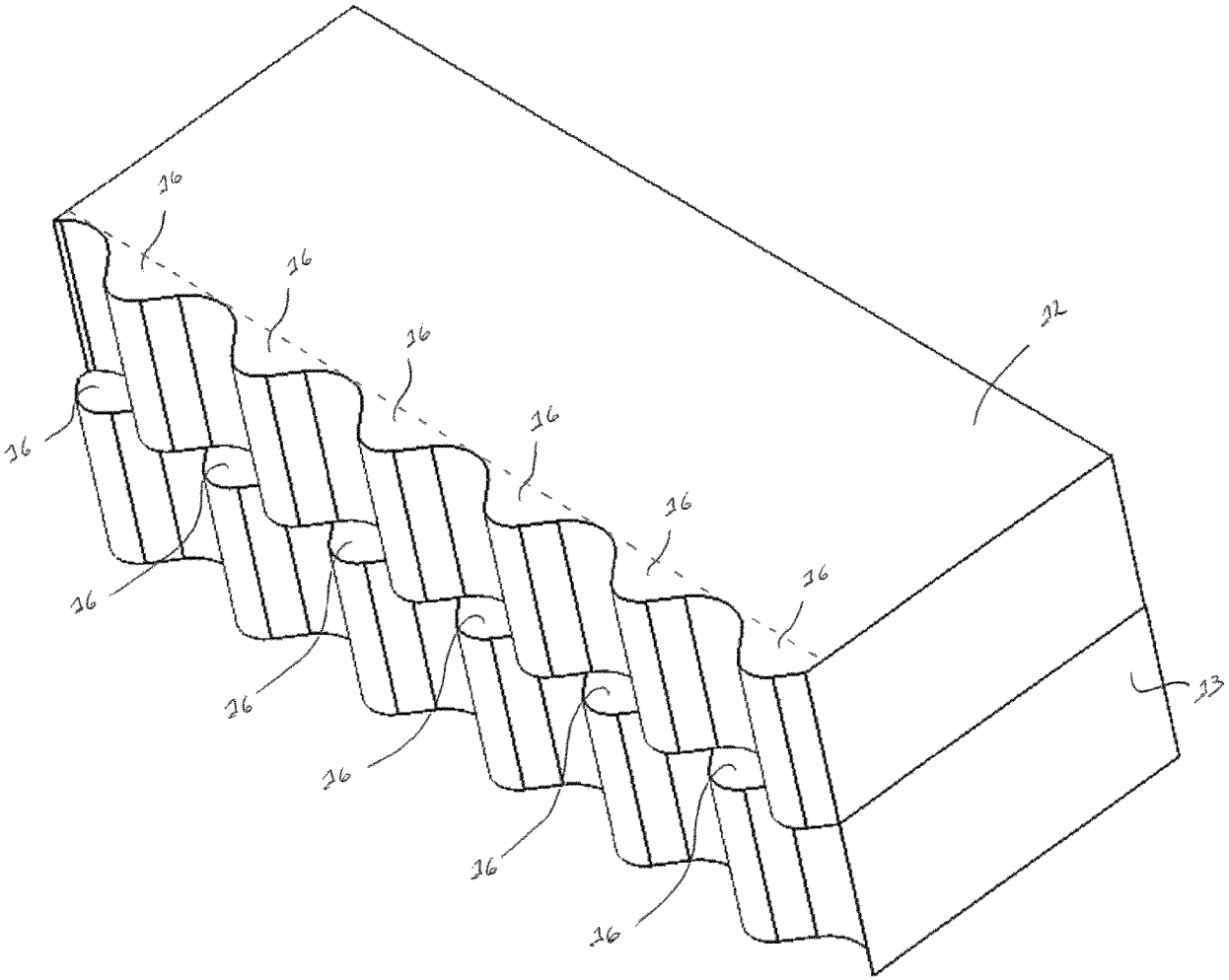

FIG. 3 A frontal perspective view of one of the concrete slabs poured against the expansion joint according to the invention, showing the antiphase denticulated edges of the upper (12) and lower (13) portion of said slab.

Figure 4:
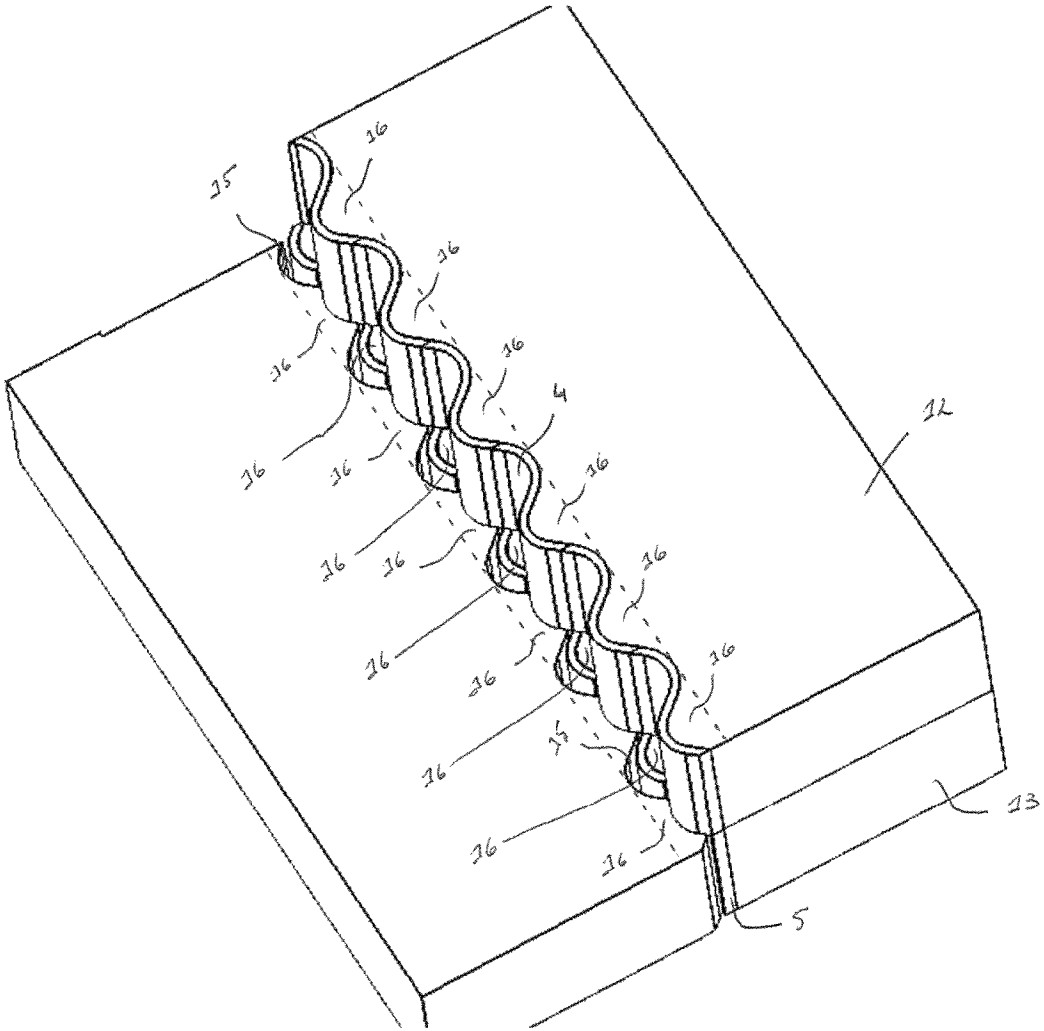

FIG. 4 A top view of an expansion joint according to the invention. Within this figure the top portion of one of the concrete slabs is not shown, to expose how the dents (16) of the two concrete slabs interlock with one another.

Figure 5:
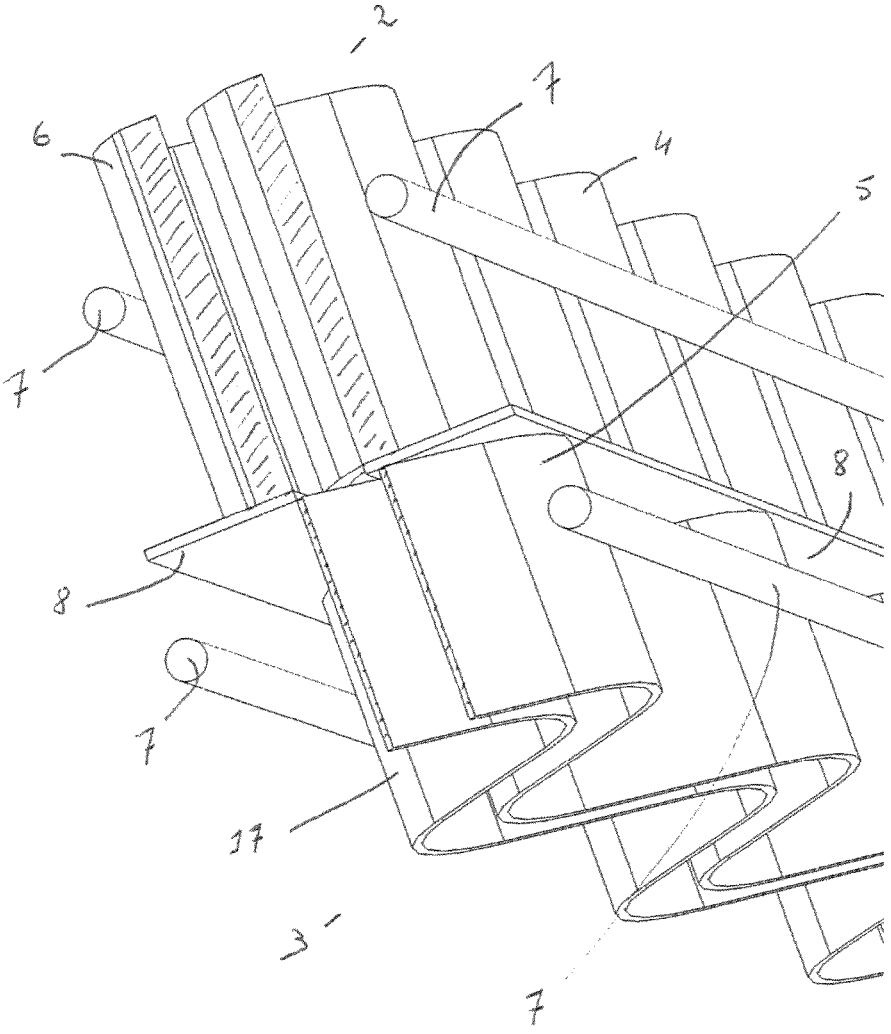

FIG. 5 A frontal view of an expansion joint according to the invention, in an open position. In this embodiment the joint comprises two pairs of corrugated plates. One pair (4, 6) in the upper portion (2) and one pair (5, 17) in the lower portion (3). Plates (4) and (5) are connected with one another through a first binding member (8) and plates (6) and (17) are connected to one another through a second binding member (8). In this embodiment, the dowels (7) to anchor the expansion joint in the concrete slabs consist of rods longitudinally welded to the corrugated plates making up the expansion joint.

Figure 6A:
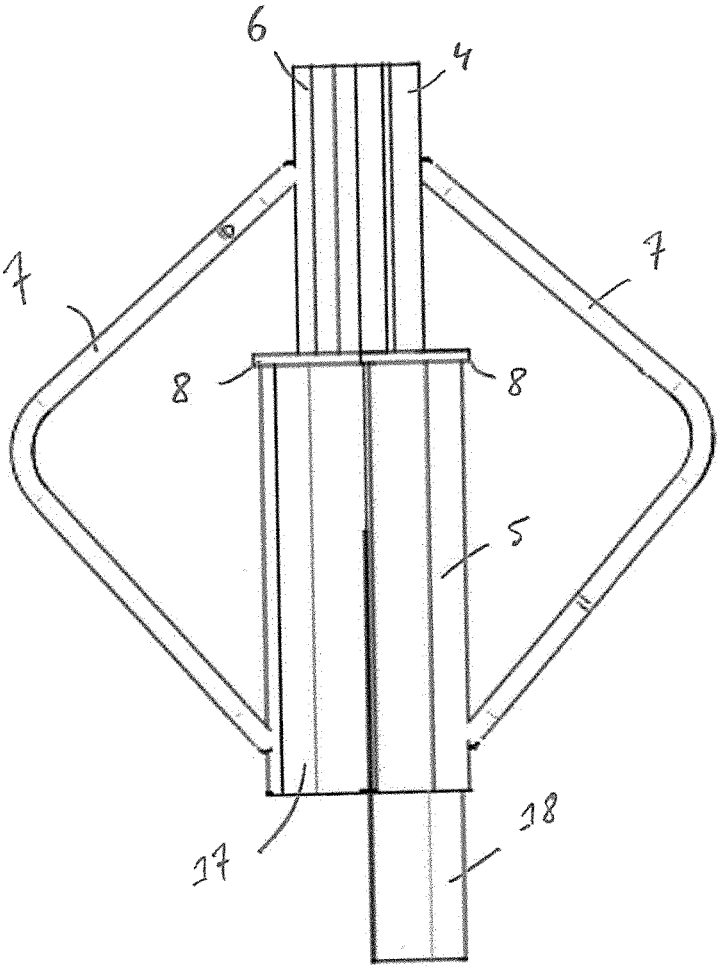

FIG. 6*a* A frontal view of an expansion joint according to the invention, having continuous bridging dowels (7) that longitudinally extend over the full length of the expansion joint, and which are connected to the upper and lower portion of the expansion joint.

Figure 6B:
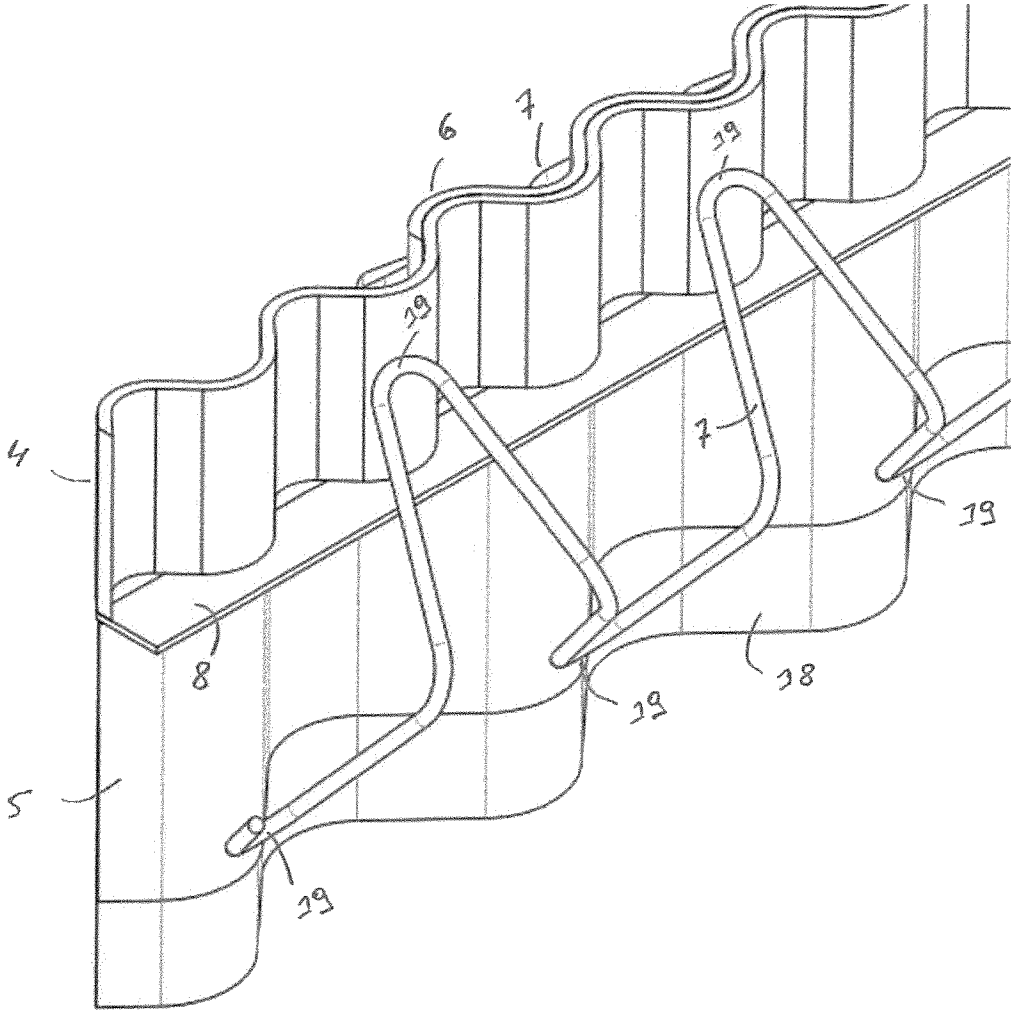

FIG. 6*b* A perspective top side view of an expansion joint according to the present invention. Showing the continuous bridging dowel (7) connected at regular intervals (19) to the upper and lower portion, and the drop plate (18) positioned in between the corrugated plates at the lower portion of the expansion joint.

Figure 6C:
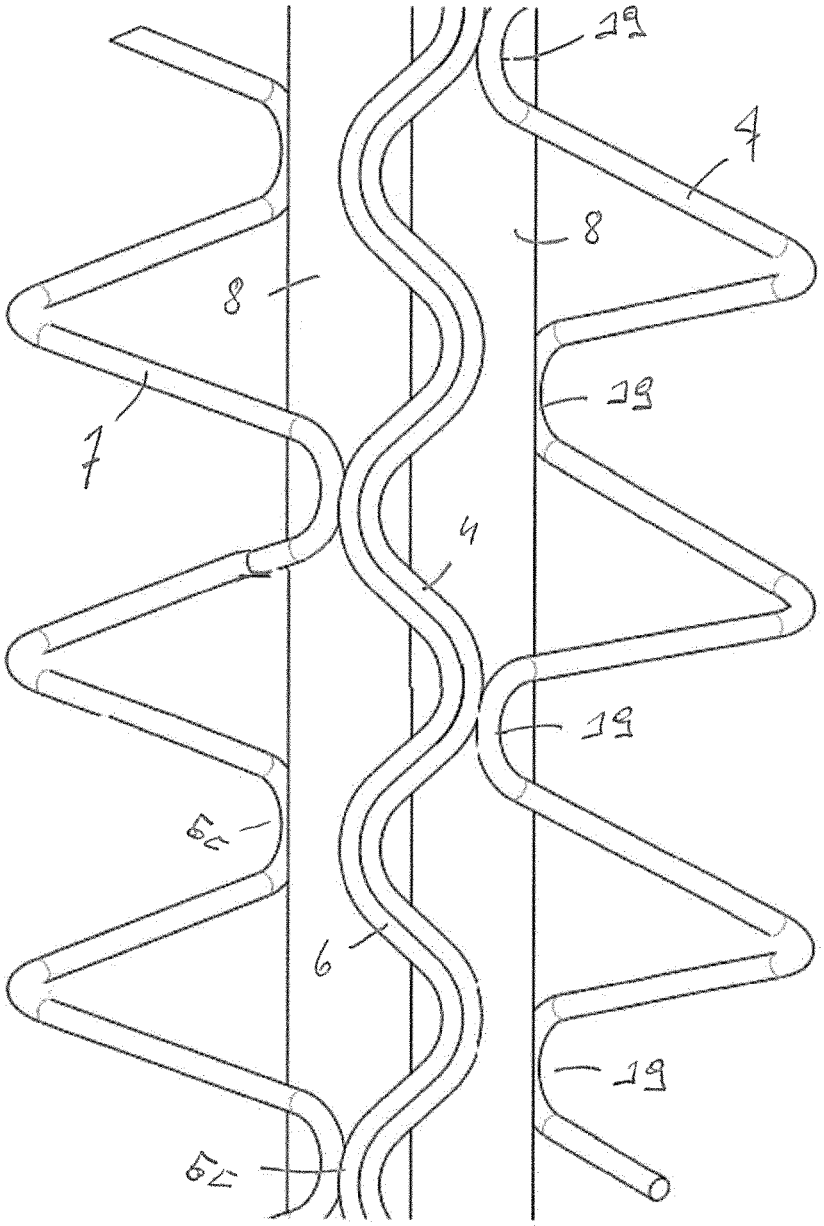

FIG. 6*c* A perspective top view of an expansion joint according to the present invention. Showing the continuous bridging dowel (7) connected at regular intervals (19) to the upper (4) and lower portion, and the binding member (8) positioned in between the upper and the lower portion of the expansion joint. It further shows the second corrugated plate (6) that fits within the undulations of the vertically oriented corrugated plate of the upper (4) portion.

With reference to FIGS. 1 and 2, the expansion joint according to the present invention has an upper (2) and lower (3) portion each comprising a vertically oriented corrugated plate (4, 5), characterized in that the corrugated plates of the upper (4) and lower (5) portion are out of phase to one another.

Within the context of the present invention there is no particular limitation as to the corrugation of the plates, in principle any alternating form is suitable, including wave, zigzag or dent forms. Where the amplitude and width of the corrugation between the upper and lower portion may be different, in one embodiment the corrugation of the upper and lower plates will be the same. In a particular embodiment the corrugation will consist of a waveform. In a more particular embodiment the corrugation of the upper and lower plate will be the same and consisting of a waveform.

The upper and lower corrugated plates (4, 5) will be in substantially the same lateral plane, but out of phase to one another. In particular in antiphase to one another. Said upper (4) and lower (5) corrugated plates are secured to one another, e.g. by welding (10), forced coupling with adhesive or other processes. In one embodiment the corrugated plates are secured to one another through a binding member (8) typically consisting of a metal sheet, more in particular a thin steel sheet, bound to both the upper (4) and lower (5) corrugated plates, e.g. by welding (10), forced coupling with adhesive or other processes. The presence of this binding member not only strengthens the connection between the upper (4) and lower (5) corrugated plates, but also assists in shielding eventual cross-flow of concrete from one side of the expansion joint to the other side when pouring the concrete slabs.

The expansion joint may further comprise anchoring dowels (7) to anchor the device in the slabs. The anchoring dowels may have any shape typically used. In general, the geometry of these anchoring elements does not modify the features of the invention. Also in the embodiments of FIGS. 1 & 2, the anchoring dowels (7) may be anchoring elements of any suitable shape or size. Evidently, said anchoring dowels are present on one side of either the upper (4) corrugated plate, the lower (5) corrugated plate, or even both, to anchor the joint profile in just one slab of the adjacent slabs. In an even further embodiment the anchoring dowels may bridge, and are accordingly connected to, the upper and lower portion of the expansion joint. With reference to FIG. 6, in a particular embodiment such an anchoring dowel bridging the upper and lower portion, consists of a dowel longitudinally extended over the full length of the expansion joint and meandering over the upper and lower portion of said joint. It is firmly connected at regular intervals (19) to both the upper and lower portion of the expansion joint, e.g. by welding, forced coupling with adhesive or other processes. Such continuous bridging dowel provides further stability and torsion strength to the expansion joint.

Thus in a further embodiment the present invention provides a continuous bridging dowel (7), connected at regular intervals (19) to an upper and lower portion of the side faces of the expansion joint and characterized in that it longitudinally extends and meanders over the full length of the expansion joint. In particular to the upper and lower portion of an expansion joint according to the present invention. As will be evident to a skilled artisan, the application of this continuous bridging dowel is not limited to the corrugated expansion joints of the present invention, but may as well be applied to any existing expansion joints.

With reference to FIGS. 6*a* and 6*c*, in a particular embodiment the continuous bridging anchoring dowel is further characterized in that, in between the consecutive connection points (19) to the respective upper and lower portion of the expansion joint, the dowel is V-shaped when viewed from a cross sectional front view (FIG. 6*a*) and when viewed from a top view (FIG. 6*c*). In other words, in a particular embodiment the continuous bridging dowel is further characterized in that in between each of said connection points and when viewed in cross sectional front view or top view, the bridging dowel is V-shaped.

As already explained hereinbefore, the concrete edge on the other side of the joint may further be protected by (a) second corrugated plate(s) (6), (17) that fits within the undulations (11) of the vertically oriented corrugated plate of the upper (4) portion, and/or the undulations of the vertically oriented corrugated plate of the lower (5) portion. At one side, this second corrugated plate(s) (6) and/or (17) may have further anchoring dowels (7) to anchor this second joint profile in the adjacent slab. This further anchoring dowel may again be an anchoring element of any suitable shape or size, including the continuous bridging dowel as described hereinbefore. As such the corrugated plates are each anchored in a slab part separated by the joint. In order to allow that the expansion joint comprising the second corrugated plate(s) is (are) easily installed, plates (4) and (6) are provisionally connected to one another, i.e. meaning that these plates are not firmly attached e.g. by welding, but are fixed together with sufficiently strong attachment means (9) such as bolts, clips or other adequate means, to allow the device to be installed easily. Within said particular embodiment wherein the expansion joints comprise two pair of corrugated plates, one pair (4, 6) in the upper portion and one pair (5, 17) in the lower portion, the corresponding upper and lower members of said pairs will be in substantially the same lateral plane, but out of phase to one another. In particular in antiphase to one another. Said upper and lower members are secured to one another, e.g. by welding (10), forced coupling with adhesive or other processes.

In other words, and with reference to FIG. 5, the upper corrugated plate (4) and its corresponding lower corrugated plate (5) will be in substantially the same lateral plane, secured to one another, but out of phase to one another; and the upper corrugated plate (6) and its corresponding lower corrugated plate (17) will be in substantially the same lateral plane, secured to one another, but out of phase to one another. In particular the plates (4, 5) and (6, 17) will be in antiphase to one another. Optionally, and in analogy with one of the foregoing embodiments, this embodiment may further comprise a binding member (8) present between, and secured to said corresponding upper and lower members. As in the foregoing embodiment this binding member (8) typically consisting of a metal sheet, more in particular a thin steel sheet, bound to both the upper (4, 6) and lower (5, 17) corrugated plates, e.g. by welding (10), forced coupling with adhesive or other processes. The presence of this binding member not only strengthens the connection between the upper (4, 6) and lower (5, 17) corrugated plates, but also assists in shielding eventual cross-flow of concrete from one side of the expansion joint to the other side when pouring the concrete slabs.

The corrugated plates (4, 5, 6, 17) used in the expansion profile of the present invention are preferably formed of a substantially rigid, metallic material, more preferably steel or stainless steel. As wear resistance of the concrete edges is predominant required at the upper portion, the corrugated plates of the upper portion are preferably made more wear resistant, such as using a different material or heavier (thicker—see FIG. 5) when compared to the corrugated plates in the lower portion. Accordingly, in an even further embodiment, the expansion joints as described herein are further characterized in that the corrugated plate(s) in the upper portion are more wear resistant when compared to the corrugated plate(s) in the lower portion.

As will be apparent to skilled artisan, said embodiments wherein the lower portion comprises a pair of corrugated plates has certain benefits when used in the manufacture of a floor member comprising said joints. The pair of corrugated plates in the lower portion ensures that the joints remain upright when placing. It further creates the opportunity of introducing a drop plate (18) between said pair of corrugated plates in the lower portion, thus extending the range in the thickness of floor member that can be made using the expansion joints of the present invention (see also FIG. 6) It is thus an object of the present invention to include a further drop plate to said expansion joints as described herein and having a pair of corrugated plates in the lower portion.

With reference to FIGS. 3 and 4, the edges of concrete slabs poured against the expansion joint as described herein will have an denticulated upper portion (12) and a denticulated lower portion (13) both denticulations being out of phase to one another in accordance with the phase shift of the upper (4) and lower (5) corrugated plate in the expansion joint, and accordingly interlock with the denticulated upper (14) and lower portion edge (15) of the adjacent slab. The dents (16) thus created in the adjacent concrete slabs will at the one hand realize the vertical fixation of floor and on the other hand allow a quasi continuous load transfer from one side to the other. Evidently, and as already mentioned hereinbefore, the amplitude and width of the corrugation in the lower (5) corrugated plate of the expansion joint will determine the maximally supported expansion of the expansion joint. The moment the denticulated upper portion edge of the concrete slab is retracted beyond the denticulated lower portion of the adjacent slab, the latter no longer supports the former and vertical fixation and load transfer are lost.

Where there are no particular limitation to the amplitude and shape of the corrugations in said plate, typical application in the manufacture of industrial concrete floors requires an expansion range of up to about 50 mm, in particular up to about 35 mm; more in particular up to about 20 mm. Consequently the amplitude of the corrugation should be such that upon maximal expansion of the expansion joint, the dents of the lower portion of the adjacent slab still support the dents of the upper portion of the opposing slab. Within the aforementioned range, the amplitude of the corrugation will be from about 25 mm to about 75 mm; in particular from about 25 mm to about 55 mm; more in particular from about 25 mm to about 35 mm.

In a further aspect, and based on the foregoing benefits regarding the pair of corrugated plates in the lower portion including a quasi continuous load transfer and a horizontal fixation between adjacent floor slabs, the corrugated joint in the upper portion of the expansion joint may be replaced with a straight joint.

In said case the expansion joint according to the present invention is characterized in having an upper (2) and lower (3) portion, characterized in that the upper portion provides a dividing member (4); in particular a pair of dividing members (4, 6) and in that the lower portion comprises a vertically oriented corrugated plate (5), in particular a pair of vertically oriented corrugated plates (5) and (17). As used herein, the dividing member(s) in the upper portion are there to create the upper edges and corresponding joint of the adjacent floor slabs. In principle any suitable means to create such joint can be applied as dividing members in the upper portion of the expansion joint as described herein. Again and in analogy with what has been described hereinbefore, said dividing members in the expansion profile of the present invention are preferably formed of a substantially rigid, metallic material, more preferably steel or stainless steel. As wear resistance of the concrete edges is predominant required at the upper portion, the dividing members of the upper portion are preferably made more wear resistant, such as using a different material or heavier (thicker—see FIG. 5) when compared to the corrugated plates in the lower portion.

In one embodiment said pair of dividing members in the upper portion consists of a pair of vertically oriented corrugated plates (4) and (6) wherein said pair of corrugated plates is out of phase with the pair of corrugated plates (5) and (17) in the lower portion. Again, these plates are secured to one another, either directly or by means of a binding member (8) as described herein before.

In another embodiment said pair of dividing members in the upper portion consists of a pair of straight and vertically oriented plates, such as for example a pair of L-profiles secured to the corrugated plates in the lower portion. The L-profiles of the upper portion and the corrugated plates of the lower portion are secured to one another, e.g. by welding (10), forced coupling with adhesive or other processes.

Again and in analogy with the previously described embodiments, the vertical orientation of the dividing members in the upper portion is their orientation with respect to the floor surface, i.e. the plates are standing upright, i.e. perpendicular, with respect to the floor surface. In other words, with their thin side facing the floor surface.

The invention claimed is:

1. An expansion joint configured to bridge and transfer a load across an expansion gap between two parts of adjacent concrete slabs used in floor construction, said expansion joint having an upper portion and a lower portion, wherein:

the upper portion provides a first dividing member, and the lower portion comprises a first vertically oriented corrugated plate, wherein the first vertically oriented corrugated plate of the lower portion is vertically oriented with respect to a surface of a floor, wherein the first dividing member of the upper portion creates upper edges of the adjacent concrete slabs of the floor, wherein the lower portion further comprises a second vertically oriented corrugated plate that fits within undulations of the first vertically oriented corrugated plate of the lower portion, wherein the lower portion further comprises a corrugated drop plate fitted in between the first vertically oriented corrugated plate of the lower portion and the second vertically oriented corrugated plate of the lower portion, and wherein the corrugated drop plate contacts at least one of the first vertically oriented corrugated plate of the lower portion or the second vertically oriented corrugated plate of the lower portion.

2. The expansion joint according to claim 1, wherein the first dividing member in the upper portion is either a vertically oriented straight plate or a vertically oriented corrugated plate, wherein the vertically oriented straight plate or the vertically oriented corrugated plate of the upper portion is vertically oriented with respect to the surface of the floor.

3. The expansion joint according to claim 1, wherein the first dividing member in the upper portion is a first vertically oriented corrugated plate, wherein the first vertically oriented corrugated plate of the upper portion is vertically oriented with respect to the surface of the floor, and wherein the first vertically oriented corrugated plate of the upper portion and the first vertically oriented corrugated plate of the lower portion are out of phase to one another.

4. The expansion joint according to claim 3, wherein corrugation of the first vertically oriented corrugated plate of the upper portion and the first vertically oriented corrugated plate of the lower portion is the same.

5. The expansion joint according to claim 4, wherein the corrugation consists of a waveform.

6. The expansion joint according to claim 3, wherein the first vertically oriented corrugated plate of the upper portion and the first vertically oriented corrugated plate of the lower portion are in substantially the same lateral plane.

7. The expansion joint according to claim 3, wherein the first vertically oriented corrugated plate of the upper portion and the first vertically oriented corrugated plate of the lower portion are in antiphase.

8. The expansion joint according to claim 3, wherein the first dividing member of the upper portion and the first vertically oriented corrugated plate of the lower portion are secured to one another.

9. The expansion joint according to claim 8, wherein the first dividing member of the upper portion and the first vertically oriented corrugated plate of the lower portion are secured to one another through a binding member.

10. The expansion joint according to claim 3, wherein the upper portion further comprises a second dividing member, wherein the second dividing member is a second vertically oriented corrugated plate that fits within undulations of the first vertically oriented corrugated plate of the upper portion.

11. The expansion joint according to claim 10, wherein the first vertically oriented corrugated plate of the upper portion and the second vertically oriented corrugated plate of the upper portion are provisionally connected to one another.

12. The expansion joint according to claim 10, wherein the second vertically oriented corrugated plate of the lower portion is in substantially the same lateral plane as the second vertically oriented corrugated plate of the upper portion.

13. The expansion joint according to claim 10, wherein the second vertically oriented corrugated plate of the upper portion and the second vertically oriented corrugated plate of the lower portion are in antiphase.

14. The expansion joint according to claim 10, wherein the second vertically oriented corrugated plate of the upper portion and the second vertically oriented corrugated plate of the lower portion are secured to one another.

15. The expansion joint according to claim 14, wherein the second vertically oriented corrugated plate of the upper portion and the second vertically oriented corrugated plate of the lower portion are secured to one another through a binding member.

16. The expansion joint according to claim 10, wherein the first dividing member of the upper portion, the second dividing member of the upper portion, the first vertically oriented corrugated plate of the lower portion, and the second vertically oriented corrugated plate of the lower portion are formed of a substantially rigid material.

17. The expansion joint according to claim 10, wherein the first dividing member of the upper portion and the second dividing member of the upper portion are formed of a more wear resistant material compared to the first vertically oriented corrugated plate of the lower portion and the second vertically oriented corrugated plate of the lower portion.

18. The expansion joint according to claim 1, further comprising anchoring dowels.

19. The expansion joint according to claim 1, further comprising a continuous bridging dowel directly connected at regular intervals to an upper and lower portion of side faces of the expansion joint, wherein the continuous bridging dowel longitudinally extends and meanders over the full length of the expansion joint.

* * * * *